United States Patent [19]

Emon

[11] Patent Number: 4,884,831

[45] Date of Patent: Dec. 5, 1989

[54] AUXILIARY DOOR LOCK FOR A POWERED GARAGE DOOR

[76] Inventor: Randall S. Emon, 936 N. Martin St., Rialto, Calif. 92376

[21] Appl. No.: 61,974

[22] Filed: Jun. 15, 1987

[51] Int. Cl.[4] ..... E05C 9/24

[52] U.S. Cl. ..... 292/38; 49/199; 49/280

[58] Field of Search ..... 292/38, 139, 167, 196, 292/222, 225; 49/280, 199, 200

[56] References Cited

U.S. PATENT DOCUMENTS

| | | | |
|---|---|---|---|
| 1,615,120 | 1/1927 | Fischer | 292/38 |
| 3,368,307 | 2/1968 | Prudy | 49/280 |
| 3,708,917 | 1/1973 | Streeter | 49/199 X |
| 4,080,757 | 3/1978 | Westerman | 29/DIG. 36 X |
| 4,597,224 | 7/1986 | Tucker | 49/280 X |

*Primary Examiner*—Richard E. Moore

*Attorney, Agent, or Firm*—Boniard I. Brown

[57] ABSTRACT

One or more spring lock devices are included at the inner sides of a conventional garage door positioned to engage with the side door frame. The spring locks are actuated to the open position by operative connection, usually through tension lines to a garage door drive mechanism, which is connected to the garage door through a lost motion mechanism so that initial movement of the drive mechanism moves the spring lock devices and opens them before the garage door mechanism moves the garage door. For closing, the spring lock devices can be of the wedge striker type which will close and lock with the closing motion of the garage door or of a straight pin type, in which case the door is adjusted so that its balance mechanisms always biases the door toward the closed position when the door is near its closed position.

7 Claims, 2 Drawing Sheets

AUXILIARY DOOR LOCK FOR A POWERED GARAGE DOOR

BACKGROUND OF THE INVENTION

Radio controlled or switch controlled garage door opening and closing mechanisms are well known in the art. Such devices usually include an electric motor connected by a gear box and a chain, screw or wire drive mechanism to the garage door. When actuated, the motor opens and closes the garage door as is desired. Most modern garage door openers, typical of those for use in residential areas, rely on the inability of the drive mechanism to be back driven by force applied to the door to keep the garage door in a closed position. This is true even though locking devices such as shown in CURRY, U.S. Pat. No. 2,562,176 and HAYWARD, U.S. Pat. No. 3,996,591 are available. In CURRY, a solenoid actuated as part of the opening sequence for the drive motor is used to open a locked device on the garage door whereas a 90° rotating motor is used to withdraw and position door locking pins in HAYWARD.

Such locking devices, even though effective, must be included in the original garage door opener design and cannot be retrofitted conveniently to existing door opener installations. They also cannot necessarily provide lock mechanisms at positions on the garage door which are best able to resist unauthorized opening forces. Therefore, there has been a need for an auxiliary locking device for powered garage door openers which is easy to install, can be installed in conjunction with most garage door openers, and which can be installed by a homeowner with little initial or installation cost.

BRIEF SUMMARY OF THE PRESENT INVENTION

The present invention provides a mechanism for locking the sides of a powered garage door to its door frame. Usually the mechanism includes a pair of spring loaded, locking devices similar to those having a striker and a wedge-shaped locking bolt used on ordinary doors. Each wedge-shaped locking bolt may include a striker abutment latch to assure it cannot be shimmed open with a credit card or other similar device. Simple spring loaded dead bolts also may be used. The locking devices are spaced back-to-back on opposite inner sides of the door and are connected together by a generally horizontal, flexible line, such as a wire or cable, which is routed beneath wire guides attached to the door on opposite sides of the centerline thereof. A yoke, which may include a relatively stiff tension spring and a turnbuckle, connects the approximate center of this horizontal wire to a vertical connecting wire. This vertical wire is routed about a pulley adjacent the upper edge of the garage door and from there is connected to the door drive mechanism. As a modification to a normal opener installation, the door drive mechanism is connected to the door through a linear lost motion linkage. A typical lost motion linkage suitable for such applications is one which has a slotted bar pivotally connected to the top of the garage door, and a pair of clevis pins attached to the drive mechanism extending through the slot for a limited sliding motion therein.

When properly adjusted, the first opening motion of the drive mechanism lifts the vertical wire with respect to the door which vertical motion is converted into inward motion of the outer ends of the horizontal wire connected to the spring loaded locking device. This moves the locking devices to their unlocked positions to unlock the door. Further motion of the drive mechanism is then transmitted to the top of the door by the slotted bar to open the door upwardly.

When it is desired to close the door, the drive mechanism moving in the opposite direction, forces the door shut causing the wedge locking bolts to engage their strikers and lock the door. If spring-loaded pins are provided as locking devices rather than the more conventional wedge and striker devices, the balance mechanism for the door must be adjusted so that the weight of the door is partially supported by the vertical wire and the spring locking devices until the door has completely closed, at which point the continued closing motion of the drive mechanism allows the pins to engage suitable strikers on the door frame.

Therefore, it is a principle object of the present invention to provide locking means for powered garage doors which can be retrofitted to a large number of residential garage door opener installations.

Another object is to provide means to securely lock a powered garage door without reliance on the lack of flexibility or inability to back drive the garage door opener mechanism.

Another object is to provide an auxiliary door locking device for powered garage doors which can be economically constructed and installed with a minimum modification to existing installations or as part of an original garage door opener kit.

These and other objects and advantages of the present invention will become apparent to those skilled in the art after considering the following detailed Specification together with the accompanying drawings wherein:

DETAILED DESCRIPTION OF THE SHOWN EMBODIMENT

Figure 1:
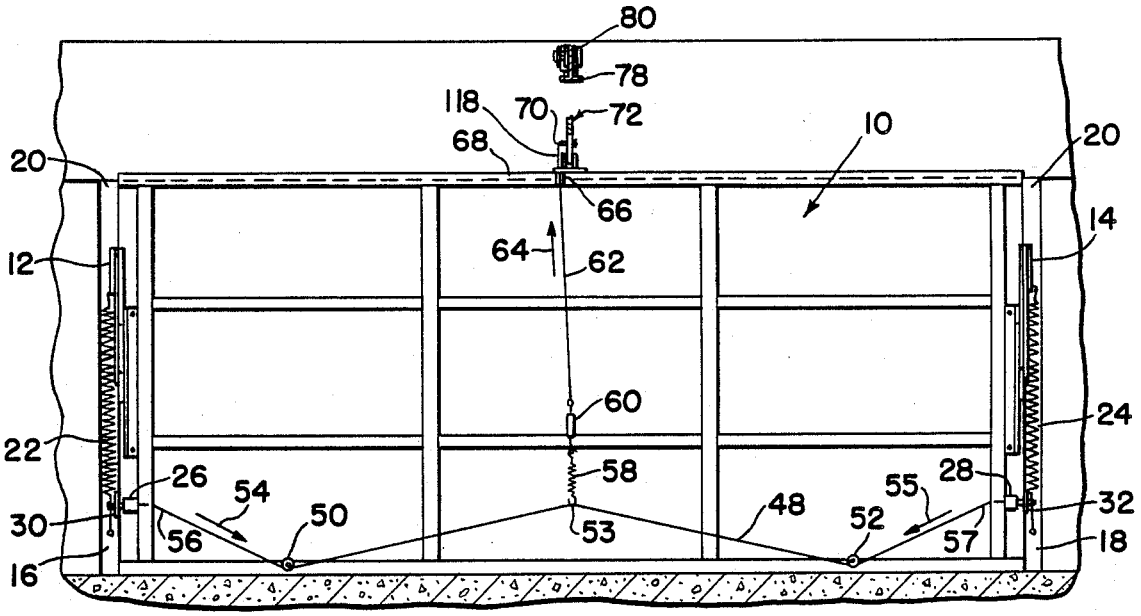
FIG. 1 is a rear elevational view of a garage door having the present invention installed thereon.

Referring to the drawings, more particularly by reference numbers, number 10 in FIG. 1 refers to a vertically lifting garage door which is mounted by means of linkages 12 and 14 to the sides 16 and 18 of a door frame 20. Springs 22 and 24 are shown being used to balance the weight of the door 10 so that excessive force is not required during opening or closing operations. Although the door 10 is shown as a linkage hinged type, other powered doors, whether of the track or sectioned roller type, can be accommodated.

Figure 2:
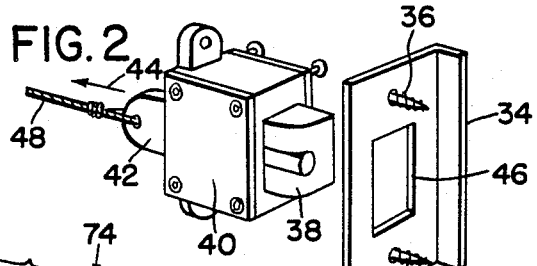
FIG. 2 is a detail, perspective view of a typical locking device useful with the present invention.

The door 10 is maintained in a secure locked condition by a pair of locking devices 26 and 28 in engagement with their strikers 30 and 32. A typical locking device is shown in FIG. 2 having a striker 34 adapted for securing to the door frame 20 by means of screws 36 and positioned to be engaged by the wedge-shaped bolt 38 of a latch mechanism 40. The bolt 38 is connected to an opening tab 42 so that motion thereof, in the direction of arrow 44, pulls the bolt 38 from within the opening 46 of the striker 34 to unlock it. The unlocking motion in the direction of arrow 44 is transferred to the tabs 42 or other unlocking mechanisms of the locking devices 26 and 28 by means of a generally horizontal wire 48 strung therebetween. The wire 48 is strung underneath wire guide pulleys 50 and 52 so that upward motion at its center 53 causes inward sidewise motion, as shown by the arrows 54 and 55, of the outer ends 56 and 57 of the wire 48 to open the locking devices 26 and 28. The center 53 of the wire 48 is connected by an optional tension spring 58 and turnbuckle 60 to a vertical actuation wire 62 which when moved in the direction of arrow 64 causes upward motion of the center 53 of the wire 48 and hence the unlocking of the locking devices 26 and 28.

Figure 3:
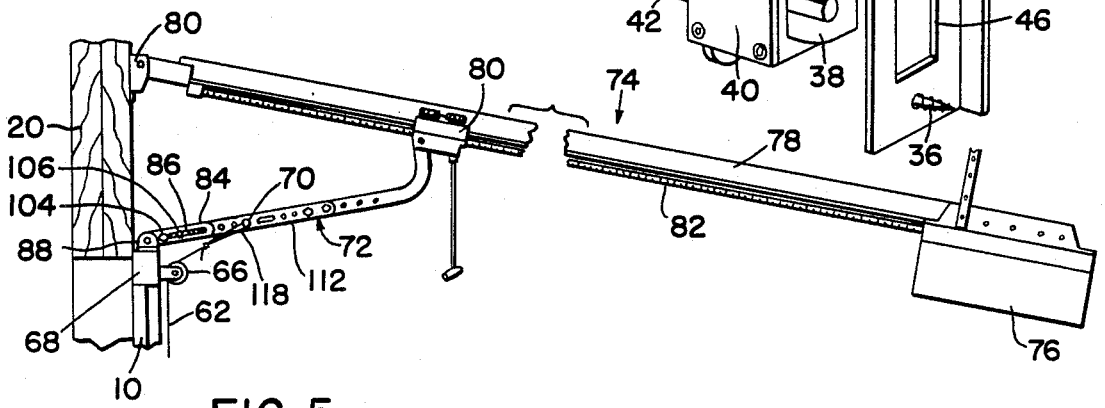
FIG. 3 is an enlarged partial cutaway side view of the upper portion of the present invention with the garage door opener in its closed and locked position.

As shown in FIG. 3, the vertical wire 62 extends over a pulley 66, connected adjacent the upper edge 68 of the garage door 10, to a clevis pin 70. The clevis pin 70 is connected to the actuation arm 72 of a powered garage door opener 74 which is represented as generic to those employed with powered residential garage door mechanisms. The opener 74 is shown including a drive motor assembly 76 and a T-rail 78 connected between the motor 76 and a header bracket 80. A trolley 80 rides on the T-rail 78 and is driven fore and aft by a jack screw 82 rotated by the motor assembly 76. The actuation arm 72 is pivotally connected to the trolley 80 and is driven thereby.

Figure 4:
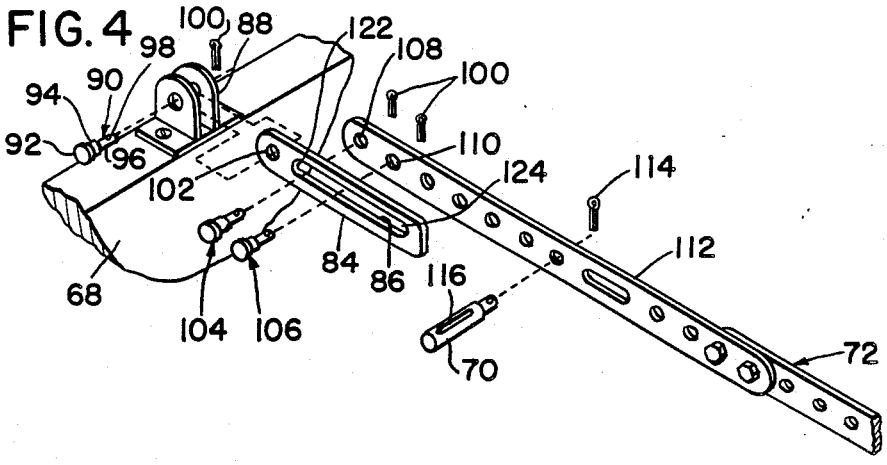
FIG. 4 is a exploded detailed view showing the modifications required to a standard installation at the top of a garage door to install the present invention.

In FIG. 3 the garage door opener 74 is shown in its closed and locked position with its trolley 80 moved as far to the left as possible, in a closed position. In addition to the clevis pin 70, the conventional connection between the garage door opener 74 and the door 10 is modified by providing a bar 84 having a longitudinal slot 86. The bar 84, as shown in FIG. 4, is connected to the conventional clevis 88 by means of a universal clevis pin 90 having a head 92 and an inner shank portion 94 of one diameter and an outer shank portion 96 of a smaller diameter so that one clevis pin design can be utilized in various locations in the present invention. The reduced diameter section 96 includes a radial hole 98 therethrough, through which a cotter pin 100 can be extended to lock the clevis pin 90 in position within the clevis 88 and through a hole 102 in the bar 84. Two other clevis pins 104 and 106, identical to clevis pin 90, with their cotter pins 100, are positioned through the slot 86 in the bar 84 and the last two holes 108 and 110 of a pierced portion 112 of the actuation arm 72 to which the clevis pin 70 is also secured by a cotter pin 114. It should be noted that the clevis pin 70 includes a slot 116 through which the upper end 118 of the wire 62 can be attached in alignment with the pulley 66 and out of interference with the arm 72.

Figure 5:
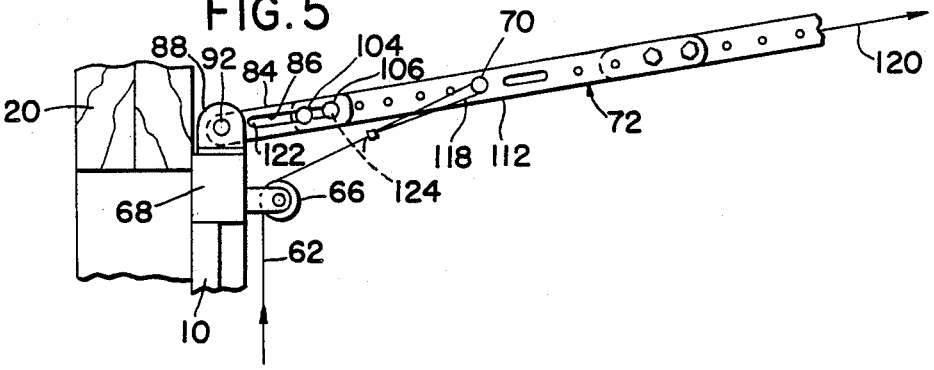
FIG. 5 is a view similar to FIG. 3 wherein the drive mechanism has unlocked the present invention and is commencing to lift the garage door.
Figure 6:
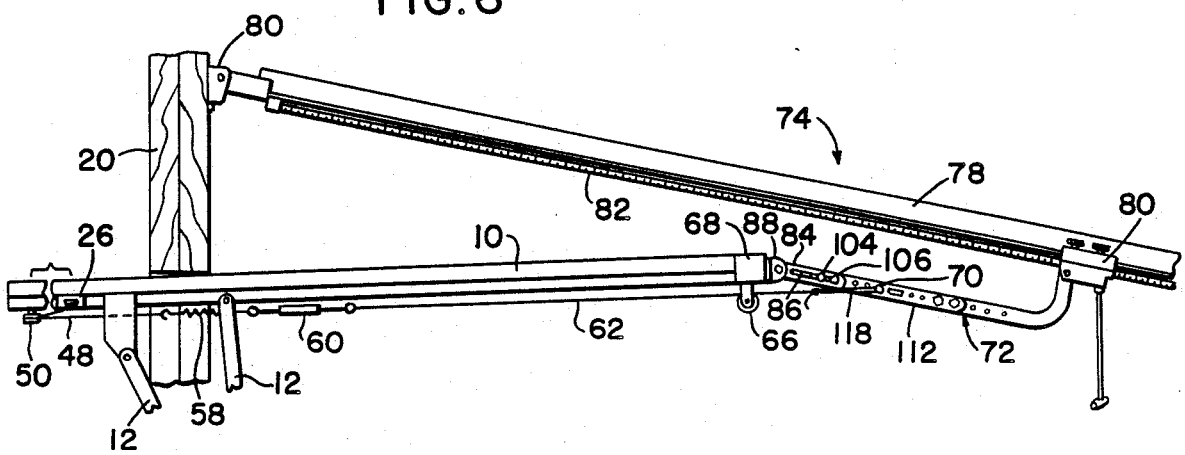
FIG. 6 is a view similar to FIGS. 3 and 5 with the garage door in its fully open position.

When the drive motor 76 of the opener 74 is actuated to open the garage door 10, initially the actuation arm 72 moves in the direction of arrow 120, but because the clevis pins 104 and 106 are initially free to slide from one end 122 of the slot 86 to the other 124, as shown in FIG. 5, and the door 10 is locked by the locking devices 26 and 28, no motion of the door 10 occurs. However, the motion of the actuation arm 72 causes relative upward motion in the direction of arrow 64 of the vertical wire 62 which causes the aforesaid unlocking of the locking devices 26 and 28. Thereafter, continued motion of the actuation arm 72 causes the door 10 to open to the position shown in FIG. 6.

Figure 7:
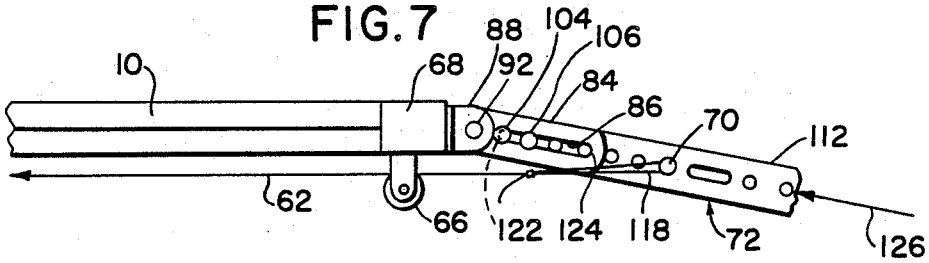
FIG. 7 is an enlarged detailed view of a portion of the drive mechanism near the beginning of a garage door closing cycle.

When the actuation arm 72 is moved in the opposite direction, as shown by arrow 126 in FIG. 7, the clevis pins 104 and 106 move toward the opposite end 122 of the slot 86, releasing the tension in the wire 62 which places the locking devices 26 and 28 in condition for again latching their strikers 30 and 32 when the door 10 is forced down by the actuation arm 72.

If straight pin or dead bolt type locking devices are used, the balance springs 22 and 24 should be adjusted to bias the door 10 downwardly. This keeps the vertical wire 62 tense in its unlocking position until the door 10 has fully closed at which point further closing motion of the actuation arm 72 allows the dead bolts to extend into their strikers. The optional turnbuckle 60 allows fine adjustment of the opening and closing position of the wire 62 whereas the tension spring 58 allows slight maladjustments and assures that no more than a predetermined lifting force for the door 10 is ever applied through the vertical wire 62.

Thus there has been shown and described a novel auxiliary locking device for powered doors which fulfills all of the objects and advantages sought therefore. Many changes, modifications, variations and other uses and applications of the subject invention will, however, become apparent to those skilled in the art after considering this Specification together with the accompanying drawings. All such changes, modifications, variations and other uses and applications which do not depart from the spirit and scope of the invention are deemed to be covered by the invention which is limited only by the claims which follow:

What is claimed is:

1. A locking mechanism for a structure-mounted door having a power door-moving mechanism connected thereto by a drive link to provide opening and closing motion to the door, said mechanism including:

at lest one locking device positioned to releasably secure the door in a closed position to the structure, locking device actuation means including:

a linear lost motion mechanism positioned between the door and the drive link which allows a limited linear motion therebetween, means to sense said limited motion and to operatively connect said limited motion to said at least one locking device to open said locking device and release the structure from the door, said linear lost motion mechanism including:

a bar member having:

a pivot connected to the door, said bar member positioned to extend therefrom toward the drive, and a slot therein with an inner end positioned toward the door, and n outer end positioned toward the drive link, and a pair of fasteners connected to the drive link and extending through said slot, said fasteners being spaced from each other a distance less than the distance between said inner and outer ends of said slot so that said fasteners can allow said limited linear motion between the door and the drive link.

2. The locking mechanism defined in Claim 1 wherein said means to sense said limited motion and to operatively connect said limited motion to said at least one locking device include:

a first flexible line connected between the drive link and said at least one locking device.

3. The locking mechanism defined in Claim 2 wherein said means to sense said limited motion and to operatively connect said limited motion to said at least one locking device further include:

a pulley in close axial relationship to said pivot over which said first flexible line extends.

4. The locking mechanism defined in Claim 3 including:

a first and second locking device positioned at opposite sides of the door to engage the structure, each of said locking devices including:

a striker connected to the structure; and a bolt mechanism, said bolt mechanism being positioned to be engagable with said striker to secure the door in a closed position, said bolt mechanism being operatively connected to said first flexible line.

5. The locking mechanism defined in Claim 4 further including:

a second flexible line operatively connected between said bolt mechanisms; and a yoke connecting said first flexible line to said second flexible line.

6. The locking mechanism defined in Claim 5 wherein said first flexible line includes:

a turnbuckle for adjustment of said operative connection between said linear lost motion mechanism and said first and second locking devices; and a tension spring to prevent the application of more than a predetermined force to the door through the first flexible line.

7. The locking mechanism defined in claim 6 further including:

a first guide connected to the door in spaced relationship to said first locking device; and a second guide connected to the door in spaced relationship to said second locking device; said second flexible line including:

a center portion at which said yoke is attached; and first and second end portions connected to said first and second locking devices respectively, said first and second end portions being positioned in contact with said first and second guides respectively.

* * * * *